United States Patent [19]

Johnson et al.

[11] Patent Number: 5,021,829

[45] Date of Patent: Jun. 4, 1991

[54] MULTICOLOR IMAGE FORMING APPARATUS AND TRANSFER ROLLER REINDEXING MECHANISM

[75] Inventors: Kevin M. Johnson; Clay E. Shoup, both of Rochester, N.Y.

[73] Assignee: Eastman Kodak Company, Rochester, N.Y.

[21] Appl. No.: 519,998

[22] Filed: May 7, 1990

[51] Int. Cl.[5] ..... G03G 5/00; G03G 21/00

[52] U.S. Cl. ..... 355/213; 355/271; 355/277; 355/317; 355/326

[58] Field of Search ..... 355/211, 212, 213, 271, 355/272, 273, 277, 279, 317, 326, 327

[56] References Cited

U.S. PATENT DOCUMENTS

| | | | |
|---|---|---|---|
| 4,072,412 | 2/1978 | Suda et al. | 355/274 |
| 4,149,796 | 4/1979 | Adachi et al. | 355/246 |
| 4,197,445 | 4/1980 | Moser | 219/216 |
| 4,341,464 | 7/1982 | Vola | 355/213 |
| 4,705,386 | 11/1987 | Ogita et al. | 355/317 X |
| 4,733,269 | 3/1988 | Kasahara et al. | 355/271 X |
| 4,739,361 | 4/1988 | Roy et al. | 355/277 |
| 4,862,214 | 8/1989 | Kasahara et al. | 355/277 |
| 4,872,037 | 10/1989 | Kasahara et al. | 355/271 |

OTHER PUBLICATIONS

U.S. 07/488,546, Jamzohel et al., filed Mar. 5, 1990.

*Primary Examiner*—A. T. Grimley
*Assistant Examiner*—J. E. Barlow, Jr.
*Attorney, Agent, or Firm*—Leonard W. Treash, Jr.

[57] ABSTRACT

A multicolor image forming apparatus which includes an image forming drum which has a gap or though in its periphery used for securing the ends of a photoconductive sheet. A transfer roller engages the drum to receive a series of different color toner images in registration to form a multicolor image. The transfer roller is driven by engagement with the periphery of the drum in a pressure nip between the drum and roller. When the gap in the drum passes through the nip, an independent motor rotates the transfer roller to a home position, thereby reindexing the roller between each series of images.

20 Claims, 3 Drawing Sheets

MULTICOLOR IMAGE FORMING APPARATUS AND TRANSFER ROLLER REINDEXING MECHANISM

FIELD OF THE INVENTION

This invention relates to the formation of multicolor toner images of the type formed in electrophotography and similar processes. More specifically, this invention relates to a multicolor image forming apparatus having a transfer roller and image forming drum, particularly adapted to high quality superposition of color toner images.

BACKGROUND ART

In conventional color electrophotography, a series of electrostatic images are created on an image member. For example, a charged photoconductive drum is imagewise exposed with an electronic flash, an electronic printhead or optical scanner. The electrostatic images are toned with different colors to create a series of different color toner images. The toner images are then transferred in registration to a receiving sheet which is repeatedly presented to the image member. Conventionally, the receiving sheet is fixed to the periphery of a transfer roller which engages the image member and rotates the receiving sheet repeatedly into transfer relation with the images as they are presented.

As dry toners are successfully made smaller, higher quality images can be formed on the image member.

Transfer of images made up of extremely fine toner particles is more difficult than transfer of more coarse toner. Ordinary electrostatic transfer has not proven as effective as has transfer involving a combination of pressure and heat.

Pressures in excess of 40 pounds per square inch, preferably pressures substantially in excess of 100 pounds per square inch, have been found to be effective in transferring small particle toners which have been heated to either their softening or sintering point. Although such a transfer process is effective with ordinary paper receivers, it is especially effective with receivers having a surface coating of a heat softenable thermoplastic. The heat softenable thermoplastic is heated to its softening point which in turn heats the toner in the nip between the receiving sheet and the toner image. The toner softens or sinters and portions of it embed in the thermoplastic material, while other portions cling to the toner so embedded. This process is most effective with much higher pressures than those used in conventional color electrophotography.

A principle limiting aspect of such systems is the ability to transfer the three or four color images in extremely accurate registration. Such registration requires that a receiving sheet carried by the transfer roller accurately present itself to each consecutive image on the image member. U.S. Pat. No. 4,872,037 shows an approach to precision in systems in which a photoconductive drum and a transfer roller are each independently driven by servo motors with the location of the transfer drum periodically monitored. A computer controls the speed of the transfer roller to assure registration of the images. With such an approach, it may be possible to accurately superimpose images in systems in which no or a light pressure is required between the image bearing member and the receiving sheet. If an independently driven drum and roller were used with substantial pressures as required in the transfer process described above, substantial wear to the image member, generally having a photoconductive surface, would result.

A solution to this problem is to allow the transfer roller to be driven by the image member. With such an approach, excessive wear between the members is not a problem. However, as multiple copies are made, registration between the transfer roller and image member has a tendency to drift. Such drift is especially prevalent if heat is used to assist transfer because of expansion of the transfer roller. Variations in thickness of the receiving sheet also can cause drift. Such drift will cause the means for securing the receiving sheet to the transfer roller, for example vacuum holes or gripping fingers, to face a different portion of the image member. If the image member is discontinuous and therefore requires that the images be formed on a particular portion, such drift is not acceptable.

DISCLOSURE OF THE INVENTION

It is an object of the invention to provide a multicolor image forming apparatus generally of the type in which a series of toner images are formed on an image member and transferred in registration to a receiving sheet carried by a transfer roller in which such problem of drift in the synchronization between the roller and the image member is corrected.

This and other objects are accomplished by an image forming apparatus in which the image member is an image drum which has an axis of revolution and a periphery on which the toner images are formed. The periphery has a gap or a trough running generally parallel to the axis. A transfer roller has an axis of revolution and a peripheral surface to which a receiving sheet is secured. It is positioned to engage the periphery of the drum forming a nip and being driven by the drum. Means are provided for rotating the transfer roller independently of the drum when the gap or trough of the drum is in the nip, to re-position the transfer roller at a home or nominal position before the beginning of the transfer of the next image or set of images.

With this structure, drift is corrected on each revolution of the image drum without the need for substantially changing the distance between the axes of the roller and drum and despite substantial pressures during transfer.

According to a preferred embodiment, a full set of different color images are formed with each revolution of the image drum so that drift is corrected between sets of images rather than for each image.

According to preferred embodiment, the gap does not extend to the ends of the drum, and the distance between the axes of the roller and the drum is maintained by disks mounted on the axis of the transfer roller that engage outer portions of the drum that do not have the gap or trough.

According to a further preferred embodiment, the resetting rotation of the transfer roller is utilized to secure a new receiving sheet to the roller. For this purpose, the means for independently rotating the transfer roller rotates the roller at a faster rotational speed than it is rotated by engagement with the image drum enabling minimization of the drum gap.

According to a further preferred embodiment, the invention is particularly usable with an image drum which includes a photoconductive peripheral surface formed on a flexible sheet, which sheet is wrapped around the periphery of a drum shaped support. The gap is formed in said drum support, and the ends of said sheet are secured to the drum support in the gap.

DESCRIPTION OF THE PREFERRED EMBODIMENT

Figure 1:
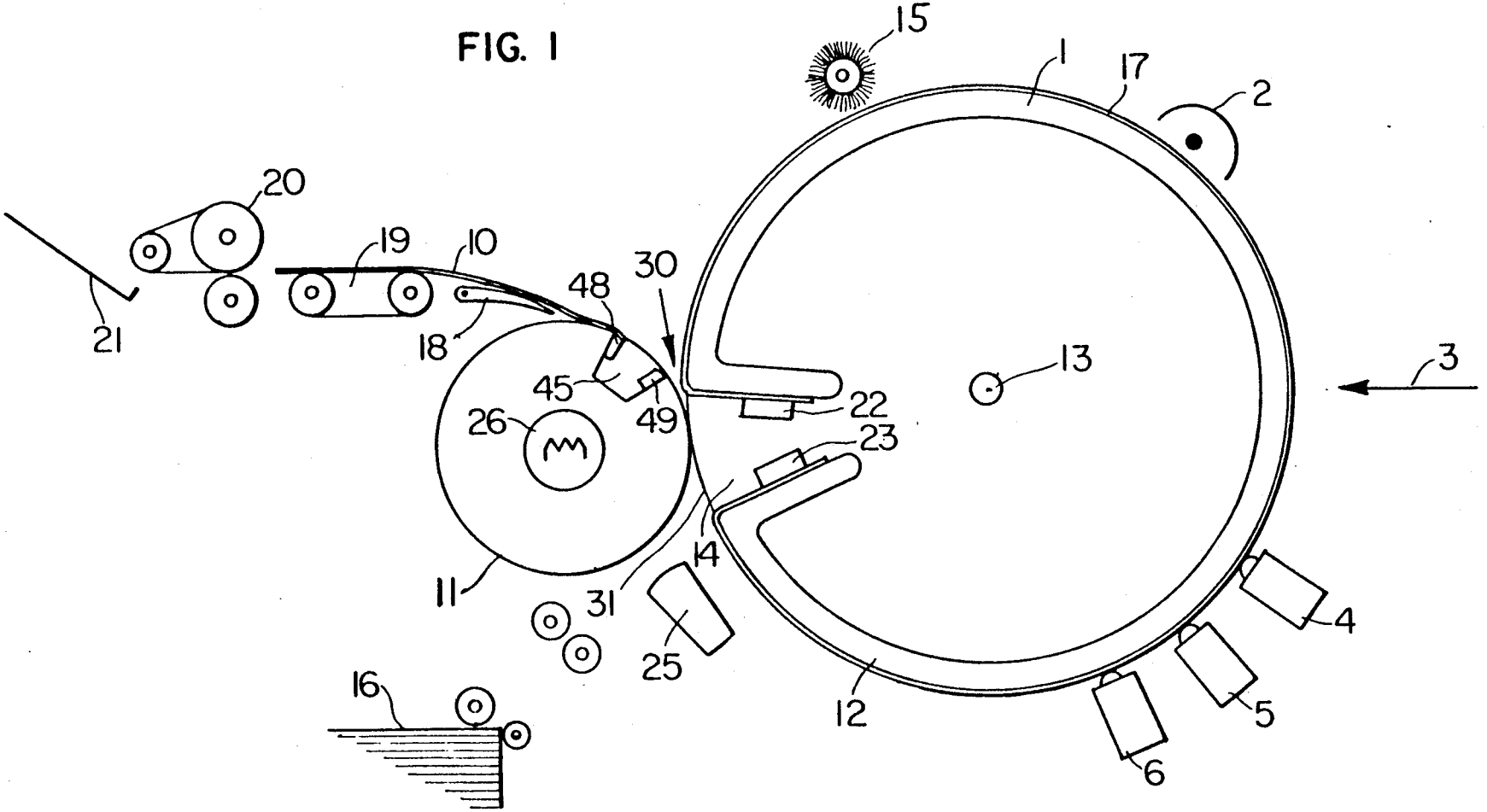
FIG. 1 is a side schematic section of a multicolor image forming apparatus constructed according to the invention with many portions eliminated for clarity of illustration.
Figure 2:
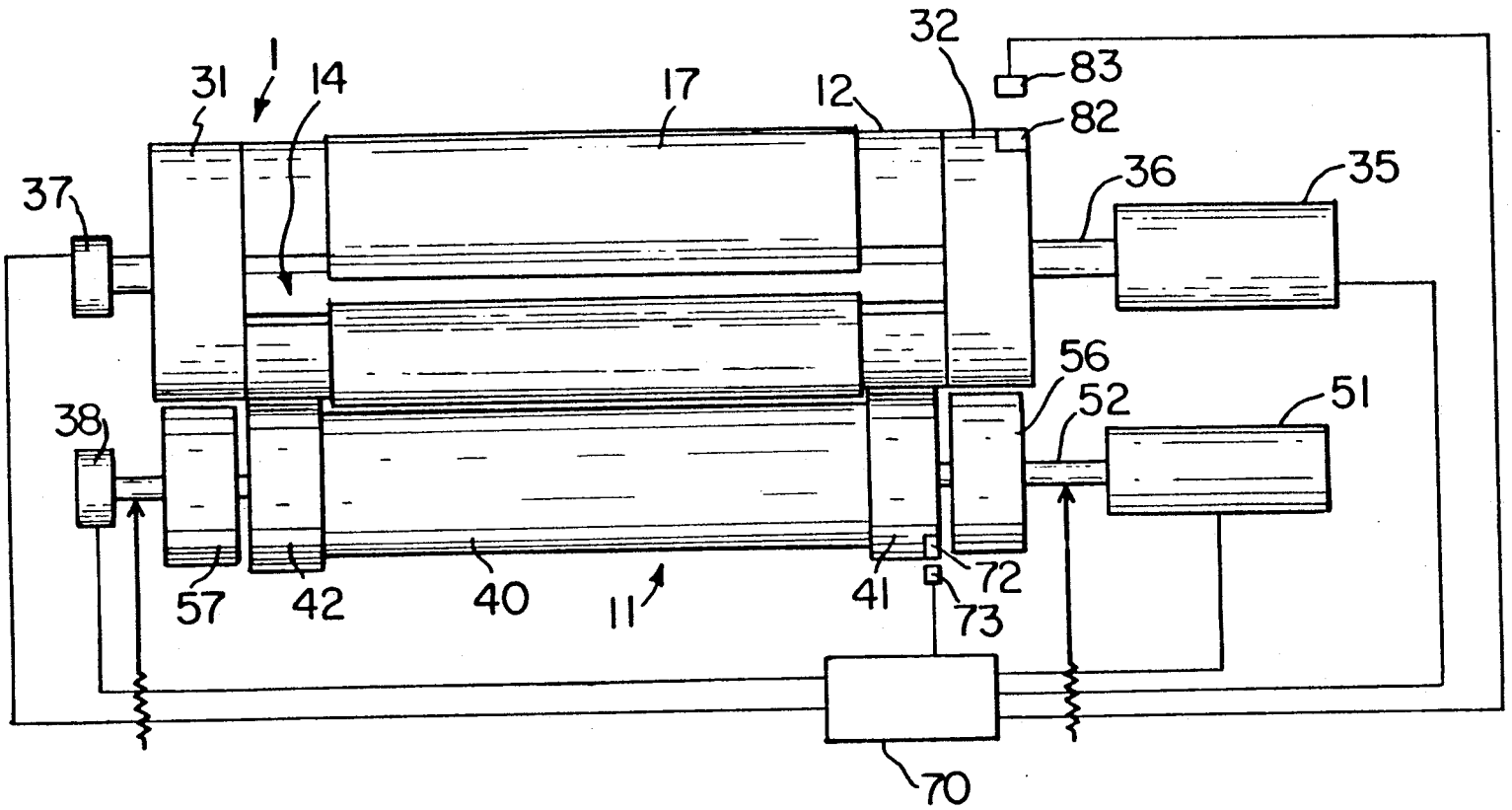
FIG. 2 is a top view of the apparatus shown in FIG. 1 also with many elements eliminated for clarity of illustration.

According to FIGS. 1 and 2, a photoconductive drum 1 includes a drum support, for example, a metallic cylinder 12 having an axis of revolution 13 and a gap or trough 14 in the periphery of the cylinder, which gap or trough runs generally parallel to the axis 13. A photoconductive sheet 17 is secured around the periphery of the cylinder 12. The photoconductive sheet 17 is clamped in the gap or trough 14 by suitable clamps 22 and 23. This is generally a known construction for a photoconductive drum. The sheet 17 itself is a multilayer structure well known in the art having at least one photoconductive layer and a conductive layer coated on a suitable support. Electrical contact to the conductive layer can be made at clamp 22 or 23. The use of a flexible photoconductive sheet has many known advantages compared to coating a photoconductive material directly on the drum. For example, the photoconductive sheet can be manufactured by ordinary coating technologies for coating webs which are considerably less expensive and very highly developed compared to drum coating approaches. Further, the photoconductive sheet can be easily replaced when its useful life is over, with or without removing the drum from the apparatus.

As illustrated in FIG. 2, the trough or gap 14 does not extend to the full ends of the drum 1 End portions 31 and 32 of drum 1 are complete cylinders. End portions 31 and 32 can be formed as part of the same cylinder 12 with the gap 14 cut or cast in the manufacturing operation. Alternatively, end portions 31 and 32 can be separate disks mounted about axis 13.

Drum 1 is driven by a motor 35 connected by a shaft 36 to cylinder 12. Shaft 36 also includes an encoder 37 which monitors the angular position of drum 1.

In operation, the photoconductive surface of drum 1 (the photoconductive surface of sheet 17) is rotated by motor 35 through a series of stations to form a series of different color toner images according to a process well known in the art. Drum 1 is first charged at charging station 2, then imagewise exposed at an exposure station, for example laser exposure station 3, to create a series of electrostatic images. Each of the electrostatic images is toned by a toner of a different color by toning stations 4, 5, and 6 to create a series of different color toner images which, when superimposed, will give the desired multicolor toner image.

To assure that the images are formed on the periphery of drum 1 and not attempted to be formed in the gap 14, the angular position of the drum is monitored by a sensing device 83 which senses a mark or other indicia 82 once each revolution (FIG. 2). Indicia 82 and sensing device 83 can also be used to assure accurate registration. An encoder 37 produces pulses responsive to drum rotation which are superposed on a clock in a logic and control 70 to control each start of scan and other actions, all as is well known in the art.

A transfer roller 11 is positioned to engage drum 1 forming a nip 30 and to be driven thereby. A receiving sheet 10 is fed from a receiving sheet supply 16 to transfer roller 11 where it is secured to its periphery. The series of different color toner images are transferred in registration to the surface of receiving sheet 10 in the nip 30. The transfer roller 11 makes one revolution for each toner image transferred to receiving sheet 10. After the series of toner images has been transferred to receiving sheet 10 to create the multicolor toner image, the receiving sheet is separated from transfer roller 11 by a separating claw 18 and conveyed by a sheet transport device 19 to a fixing device 20 and then to an output tray 21, as is well known in the art. The photoconductive surface of drum 1 is cleaned at cleaning station 15 for reuse.

Conventional electrostatic transfer of ordinary toner images is commonly carried out with light or no pressure between the receiving sheet 10 and the photoconductive surface of drum 1. However, such transfer has shown to be inferior for transferring extremely small toner particles, for example particles as small as 3.5 microns and smaller. An effective approach to transferring such fine toner particles involves a combination of heat and pressure in the transfer nip 30. In this approach, the receiving sheet 10 is heated, for example, by external heating device 25 and internal heating device 26, to a temperature which causes the toner to soften and transfer under pressure to the surface of receiving sheet 10. For especially high quality work, receiving sheet 10 can have a thermoplastic overcoating which is heated to its softening point by heating devices 25 and 26. The heat of the thermoplastic coating heats the toner in the nip 30 causing it to soften or sinter. Some of the toner embeds in the softened thermoplastic layer and the rest of the toner adheres to the toner so embedded to fully transfer the toner image. For more details of this process, see U.S. patent application Ser. No. 230,381 filed on Aug. 9, 1988 to Rimai et al, which application is incorporated by reference herein.

To produce high quality multicolor images, it is necessary that the toner images be transferred in extremely accurate registration. To make full use of the fine toner particles available and the accuracy of the laser scanning image forming process, superposition of the images should be accurate to one one-thousandth of an inch. We have found such accuracy can be maintained with the structure shown in FIG. 1 with transfer drum 11 being driven by engagement between receiving sheet 10 and the photoconductive surface of drum 1. However, when multiple copies are made, the registration between roller 11 and drum 1 drifts over usage. This is due to slight changes in the circumference of drum 11 as it is heated, variations in the thickness of the receiving sheet 10, and tolerances in general. With the gap or trough 14 determining the location of the images on drum 1, such drift must be eliminated. The roller 11 also includes a trough 45 in which the ends of the transfer sheet 10 are secured. These securing means cannot be allowed to drift into the image areas of photoconductive drum 1.

To solve this problem a separate motor 51 is fixed to a shaft 52 of transfer roller 11. Motor 51 rotate transfer roller 11 when the trough 14 is in the nip 30. To accomplish this, transfer roller 11 is of multipart construction as seen best in FIG. 3. More specifically, transfer roller 11 includes a central portion 40 which has a trough 45. A pair of vacuum drop-off bars 48 and 49 are mounted in trough 45 for securing the ends of receiving sheet 10. On each side of central portion 40 are outer portions 41 and 42 which are complete cylinders, not having the trough 45. Outer portions 41 and 42 are fixed to central portion 40 and rotate with it. Outer portions 41 and 42 have a diameter slightly more than central portion 40, but slightly less than the diameter of central portion 40 and receiving sheet 10 in combination.

Outside of outer portions 41 and 42 are a pair of disks or rim-riders 56 and 57 which are also complete cylinders, are slightly less in diameter than are outer portions 41 and 42 and are free to rotate on shaft 52. Shaft 52 is spring-loaded toward drum 1 (as illustrated in FIG. 2) to provide the desired amount of pressure between the image bearing surface of drum 1 and receiving sheet 10.

In operation, the periphery of drum 1 is large enough to hold a series of, for example, 3 or 4 color images. The color images are positioned on the periphery of drum 1 by laser exposure device 3 to exactly register on receiving sheet 10. That is, the starts of scan of each image are separated by a distance equal to the circumference of roller 11, counting the compacted receiving sheet 10. Enough space is inserted between images to account for trough 45. In general, such timing is well-known in the color image forming art and utilizes encoder 37, mark 82 and sensor 83 as described above. The electrostatic images are toned by toner stations 4, 5 and 6 to create, for example, cyan, magenta and yellow toner images. While the second and third electrostatic images are being formed by exposure station 3, the first toner image is reaching transfer nip 30 where it is transferred to receiving sheet 10. Transfer roller 11 is driven by the periphery of drum 1 which contacts receiving sheet 10 and, when facing trough 45, outer portions 41 and 42. The second and third toner image (and a fourth toner image in a four color system) are transferred on the second and third revolutions of transfer roller 11 to form a multicolor image on receiving sheet 10.

As the leading edge of the receiving sheet 10 leaves the nip 30, with the last toner image being transferred to receiving sheet 10, claw 18 is moved to engage the periphery of roller 11 and vacuum drop-off bar surface 51 to strip the receiving sheet 10 therefrom. The vacuum applied to vacuum drop-off bar 49 is relieved just before claw 18 engages the leading edge of sheet 10 to permit such separation.

After the third toner image has been transferred to receiving sheet 10, the trough 14 enters the nip 30 as shown in FIG. 1. At this point, neither central portion 40 nor outer portions 41 or 42 are in engagement with the periphery of drum 1 and therefore are no longer rotated by it. The axial separation between drum 1 and roller 11 is maintained by rim riders 56 and 57 which engage end portions 31 and 32 of drum 1. Since rim riders 56 and 57 are free to rotate on shaft 52, their engagement with drum 1 does not affect the rotation of roller 11 (central portion 40 and outer portions 41 and 42). Drum 1 and roller 11 can be castered (and gimbaled) together to provide a constant nip width across the nip. Maintaining the axial separation with rim riders 56 and 57 obviates the need to reestablish the caster axis.

As the trough 14 enters the nip 30, motor 51 is engaged, to drive roller 11 to continue its rotation in a counterclockwise direction as seen in FIG. 1. The first part of this rotation completes the separation of receiving sheet 10 from the periphery of central portion 40, driving it onto sheet transport 19. The motor 51 continues to rotate transfer roller 11 to bring trough 45 around to a position at which vacuum drop-off bar 49 can receive a new receiving sheet from receiving sheet supply 16 and also to position transfer roller 11 at a home position to receive the next set of images as the trailing portion of trough 14 reaches the nip and the periphery of transfer drum 1 again engages transfer roller 11 to drive it for three more revolutions to receive three new images on the new receiving sheet.

Depending on the size of trough 14, it is desirable to drive transfer roller 11 by motor 51 at a substantially increased rotational speed compared to its speed when it is driven by the periphery of drum 1. This allows a relatively narrow trough 14, but still manages to completely rotate transfer roller 11 to its home position for the next set of images. According to a preferred embodiment, transfer roller 11 can be rotated more than one time while the trough 14 is in nip 30 to completely secure the next receiving sheet to the periphery of transfer roller 11. This has the advantage of fully securing the sheet to the periphery so that it is securely held by both vacuum drop-off bars 48 and 49 for the entire transfer of the first toner image.

This operation is controlled by logic and control 70 (FIG. 2) which receives pulses from encoder 37 on shaft 36 of drum 1 and from an encoder 38 on shaft 52 of transfer roller 11 and controls the engagement and speed of motor 51. Encoder 38 can be used to position roller 11 by counting pulses from the actuation of motor 51. However, for the most precise location of transfer roller 11 at its home position to receive each set of toner images, a mark or other indicia 72 is located on transfer drum 11 and is sensed by a sensor 73, for example an optical sensor, which sends a signal to logic and control 70 that transfer roller 11 has reached its home position. The home position for transfer roller 11 can be a position in which the roller 11 is stopped with the trough 45 in the nip 30. As the trailing portion of trough 14 reaches the nip 30, the periphery of drum 1 will engage outer portions 41 and 42 of transfer roller 11 and begin its rotation with the leading edge of the transfer sheet engaging a portion of the periphery following the trailing edge of the trough 14 into nip 30.

With this approach, the rotational position of drum 1 does not have to be monitored to correctly reengage the roller and drum (although it is monitored for image formation). However, engagement can be made smoother if motor 51 is allowed to drive roller 11 after roller 11 reaches its home position at a speed dependent upon the rotational position of drum 1 (as determined by logic and control 70 from sensor 83 and encoder 37). With such a control, the parameters of the system can be chosen so that roller 11 is moving when it engages with drum 1 at substantially the speed of drum 1. A clutch can be used in the drive train of motor 51 which disengages motor 51 at the instant of engagement of drum 1 and roller 11. However, a one-way clutch on motor 51 which permits drum 1 to over drive it also will be effective and requires less exact timing.

Figure 3:
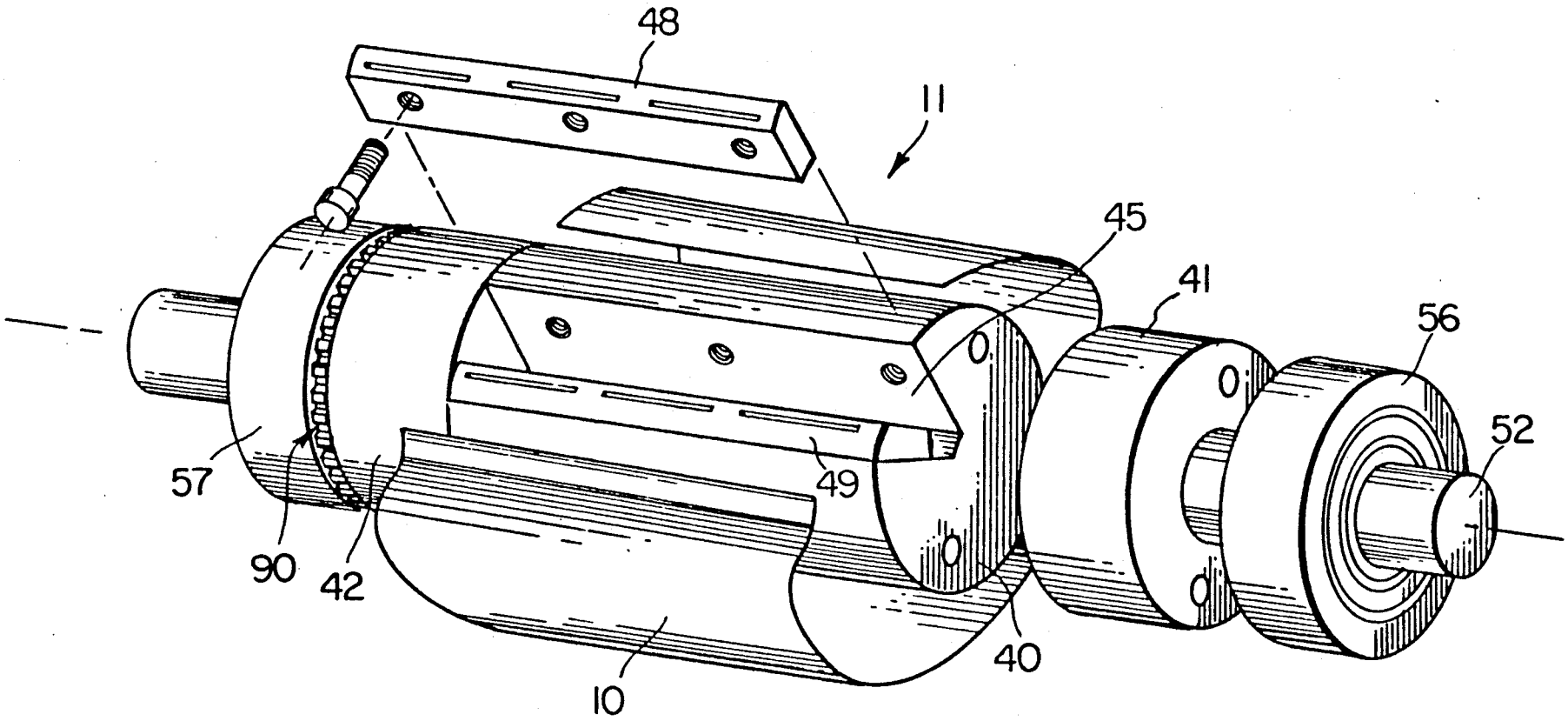
FIG. 3 is a perspective view of a transfer roller portion of the apparatus shown in FIGS. 1 and 2.

FIG. 3 illustrates an alternative embodiment to motor 51 driving roller 11 while mounted on shaft 52. A recessed gear 90 is driven through a timing belt and motor (not shown) to drive roller 11. With this approach, the gear 90 can be fixed to shaft 52 or to roller 11. If it is fixed to roller 11, roller 11 can be allowed to rotate with respect to shaft 52. This would eliminate encoder 38 using only mark 72 and sensor 73 for control of roller 11.

With all of these embodiments, the transfer roller 11 is positioned at its home position before receiving each series of toner images. The transfer drum thus is reindexed for each set of images thereby eliminating any problem of gradual drift of the trough 45 into image areas of drum 1. According to preferred embodiments, a rapid rotation of transfer drum 11 can be utilized to firmly secure the next receiving sheet to the transfer roller 11 before the first image of the following series is transferred.

According to an alternative embodiment, image drum 1 can be smaller in size and carry only a single image on its periphery at a time. In this approach, transfer roller 11 would be reindexed before transfer of each image. This approach has the aspect that color registration is now dependent upon motor 51's accuracy in reindexing roller 11. Thus, for this embodiment, motor 51 should be a high quality stepper motor and sensor 73 must be precise. In the original approach described, where all three images are transferred before reindexing, the reindexing prevents drift as described and determines the location of the image on the page, but does not control color registration and therefore needs not as precise a motor and sensing means.

Although this invention can be utilized with any method of transfer, it is particularly useable with transfers involving substantial amounts of pressure in which rotation of the transfer roller by the transfer drum during transfer is desirable. When the transfer also includes the utilization of heat, changes in the parameters of the system due to expansion of both the drum and roller from the heat of the transfer roller make particularly advantageous use of the invention.

The invention has been described in detail with particular reference to a preferred embodiment thereof, but it will be understood that variations and modifications can be effected within the spirit and scope of the invention as described hereinabove and as defined in the appended claims.

We claim:

1. Multicolor image forming apparatus comprising:

a rotatable drum, having an axis of rotation, a periphery and a gap in said periphery running generally parallel to said axis, means for creating a series of electrostatic images on said periphery, means for applying different colored toners to said electrostatic images to create a series of different color toner images, and transfer means for transferring said toner images in registration to a receiving surface to create a multicolor toner image, said transfer means comprising:

a transfer roller having an axis of rotation and positioned to engage, form a nip with, and be rotated by the periphery of said drum, means for securing a receiving sheet to a portion of the periphery of said transfer roller for receiving said series of toner images in registration as said roller is repeatedly rotated by said drum, and means independent of said drum for rotating said transfer roller to a predetermined rotational position when said gap in said drum passes through said nip.

2. Multicolor image forming apparatus according to claim 1 further including means for separating said receiving sheet from said transfer roller and means for securing a new receiving sheet to said transfer roller while said roller is being rotated by said independent means to said predetermined position.

3. Apparatus according to claim 1 wherein said means for rotating said transfer roller independent of said drum includes means for rotating said transfer roller at a rotational speed faster than said roller is rotated by said drum.

4. Apparatus according to claim 1 wherein said drum is large enough to hold an entire series of toner images to be superposed, one after another around said periphery of said drum.

5. Apparatus according to claim 1 wherein said drum is designed to hold only a single image on its periphery at a time and said roller is reindexed to said predetermined position between toner images that are superposed on a single receiving sheet.

6. Apparatus according to claim 1 further including means for maintaining the distance between the axis of the transfer roller and the axis of the drum when the gap in said drum is passing through the nip.

7. Apparatus according to claim 6 wherein said means for maintaining the distance between the axis of the transfer roller and the axis of the drum are a pair of cylindrical disks mounted on a shaft supporting said transfer roller, which disks engage the imaging drum at positions on said drum axially outside of said gap.

8. Apparatus according to claim 7 wherein said disks are rotatable with respect to said shaft for said transfer roller, thereby permitting said transfer roller to be driven by rotation of said shaft when the gap of said drum is passing through the nip.

9. Apparatus according to claim 1 wherein said roller includes a mark or other indicia capable of being sensed and said apparatus includes means for sensing the arrival of said indicia at a predetermined location indicative of arrival of said roller at said predetermined rotational position.

10. Apparatus according to claim 9 further including logic and control means, means associated with said sensing means for creating an electrical signal in response to sensing of said indicia, said logic and control including means responsive to said signal for controlling the further rotation of said roller by said rotating means to effect reengagement of said drum and roller in timed relation.

11. Apparatus according to claim 10 further including means for sensing the angular position of said drum and for creating a second signal indicative of that angular position and wherein said means for controlling further rotation of said roller is also responsive to said second signal to effect reengagement of said drum and roller with said roller being rotated by said independent means at substantially the same speed as said drum at the time of reengagement.

12. Multicolor image forming apparatus comprising:

a rotatable drum having an axis of rotation, a periphery and a trough in said periphery running generally parallel to said axis of rotation, a sheet of photoconductive material having opposite ends secured in said trough and wrapped around said periphery, means for uniformly charging said photoconductive sheet, means for imagewise exposing said charged photoconductive sheet to create a series of electrostatic images, means for applying different colored toner to said electrostatic images to create a series of toner images of different color, transfer means for transferring said toner images in registration to a receiving sheet to create a multicolor toner image, said transfer means comprising:

a transfer roller positioned to engage, form a nip with and be rotated by said photoconductive sheet supported by said drum, means for securing a receiving sheet to a portion of the periphery of said transfer roller for receiving said series of toner images in registration as said roller is repeatedly rotated by engagement of said receiving sheet with the photoconductive sheet on the periphery of said drum, means independent of said drum for rotating said transfer roller to a predetermined rotational position when said trough in said drum passes through said nip, and means for maintaining the distance between the axes of the transfer roller and the drum when the trough of said drum is passing through the nip.

13. Apparatus according to claim 12 further including means for heating the receiving sheet supported by said transfer roller.

14. Apparatus according to claim 12 further including means for heating a thermoplastic outer layer of a receiving sheet supported by said transfer roller.

15. Apparatus according to claim 12 further including means for applying pressure of at least 40 pounds per square inch between said transfer roller and said drum while said transfer roller is being rotated by said drum.

16. Apparatus according to claim 12 wherein said means for rotating said transfer roller independent of said drum, is a stepper motor.

17. Apparatus according to claim 12 wherein said roller includes indicia capable of being sensed and said apparatus includes means for sensing the arrival of said indicia at a predetermined location indicative of arrival of said roller at said predetermined rotational position.

18. Apparatus according to claim 17 further including logic and control means, means associated with said sensing means for treating an electrical signal in response to sensing of said indicia, said logic and control including means responsive to said signal for controlling the further rotation of said roller by said rotating means to effect reengagement of said drum and roller in timed relation.

19. Apparatus according to claim 18 further including means for sensing the angular position of said drum and for creating a second signal indicative of that angular position and wherein said means for controlling further rotation of said roller is also responsive to said second signal to control rotation of said roller to bring said roller to a peripheral speed equal to the peripheral speed of said drum by the time said drum and roller reengage.

20. Multicolor image forming apparatus comprising:

a rotatable drum having an axis of rotation, a periphery and a trough in said periphery running generally parallel to said axis of rotation, a sheet of photoconductive material having opposite ends secured in said trough and wrapped around said periphery, means for uniformly charging said photoconductive sheet, means for imagewise exposing said charged photoconductive sheet to create a series of electrostatic images, means for applying different colored toner to said electrostatic images to create a series of toner images of different color, a transfer roller positioned to engage, form a nip with and be rotated by said photoconductive sheet supported by said drum, means independent of said drum for rotating said transfer roller to a predetermined rotational position when said trough of said drum passes through said nip, and transfer mean for transferring said toner images in registration to a receiving surface associated with said transfer roller to create a multicolor toner image on said receiving surface.

* * * * *